United States Patent [19]

Cheng

[11] Patent Number: 4,675,645

[45] Date of Patent: Jun. 23, 1987

[54] HIGH-FREQUENCY SELECTING SWITCH TERMINAL

[76] Inventor: Yu Feng Cheng, 6th Fl., No. 140, Yen Chi Street, Taipei, Taiwan

[21] Appl. No.: 865,261

[22] Filed: May 21, 1986

[51] Int. Cl.[4] ..... H01C 13/00

[52] U.S. Cl. ..... 338/215; 338/333; 338/334

[58] Field of Search ..... 338/215, 334, 333; 200/51.1

[56] References Cited

U.S. PATENT DOCUMENTS

| | | | |
|---|---|---|---|
| 1,547,745 | 7/1925 | Goodrich | 338/215 |
| 2,214,659 | 9/1940 | Dardess | 338/334 X |
| 4,034,172 | 7/1977 | Glover et al. | 200/51.1 |

*Primary Examiner*—C. L. Albritton

*Attorney, Agent, or Firm*—Bacon & Thomas

[57] ABSTRACT

An improved high frequency selecting switch terminal comprising two conductor pins which are coaxial. When a conductor pin from a cable is inserted into the terminal, it pushes the front end of the first conductor pin forward into the front end of the second conductor pin. At the front ends of the first and second conductor pins are first and second sliding blocks which force the pins forward. Thus, input signals are transmitted from the cable to the switch. The terminal further comprises a thick film resistor which connects the front end of the second conductor pin and a conductor ring which is disposed on the front surface of the second sliding block. When the cable is removed, the first and second sliding blocks move to the original position and the conductor ring contacts with the rim of the terminal housing. In this way, the terminal absorbs undesirable signals from the surroundings so as to prevent interference.

3 Claims, 5 Drawing Figures

HIGH-FREQUENCY SELECTING SWITCH TERMINAL

BACKGROUND

There are many types of high frequency selecting switches presently in use. The switch shown in FIG. 4 has been commonly used in prior art. At the rear end of the switch are three co-axial terminals (a1, a2, and a3). Both of the side terminals (a1 and a3) are connected to the input signal cables respectively and the middle terminal (a2) is connected to the output signal cable. Two selection buttons (A and B) are disposed at the front end of the switch. If, for example, button (A) is pressed, then input terminal (a1) is connected to the output terminal (a2), with the other terminal (a3) being in an open state. Terminal (a3) sometimes receives unwanted signals from the surroundings which interfere with the output signal. In order to prevent this interference, a plug (C) was often disposed on the unused input terminal. The plug (C) has a resistor, which is connected between the housing of the plug (C) and the center conductor line of the terminal, so as to absorb any undesirable signals from the surroundings, thereby preventing interference. It is obvious that the above-mentioned design has complicated operation and testing functions and is uneconomical to manufacture.

There is another type of high frequency selecting switch which is an improvement of above-mentioned type. Referring to FIG. 5, it can be seen that the side terminals (i.e. the input signal terminals) are equipped with resistors D and D'. This design does absorb undesirable signals from the surroundings so as to prevent interference and to provide more convenient operation. However, the design shown in FIG. 5 is more difficult and expensive to manufacture. Further, this design is too bulky.

SUMMARY

A primary objective of this invention is to provide a high-frequency selecting switch terminal which has a thick film resistor providing a certain resistance so that the interference of the signals from the surroundings can be prevented when the terminal is not in use.

A further objective of this invention is to provide a high-frequency selecting switch terminal which comprises two conductor pins which are co-axially connected when the terminal is in use.

Other objectives of this invention will appear in the following description and appended claims, reference being had to accompanying drawings forming a part of this specification wherein like reference characters designate corresponding parts in the several views.

DETAILED DESCRIPTION OF THE INVENTION

Figure 1:
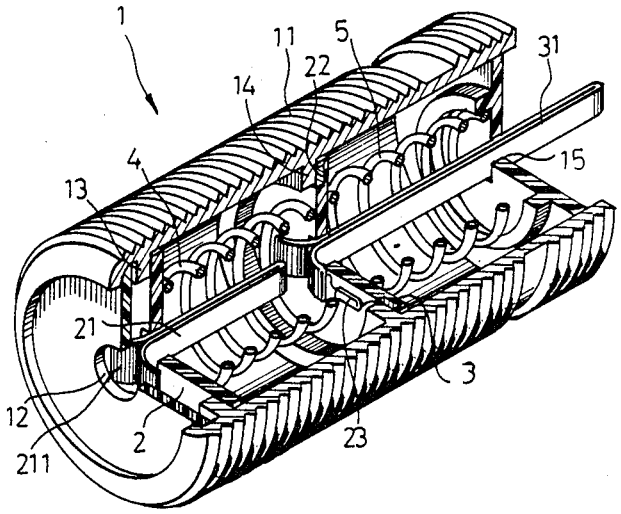
FIG. 1 is a cut-away view of the present invention which shows the inner structure of the terminal.
Figure 2:
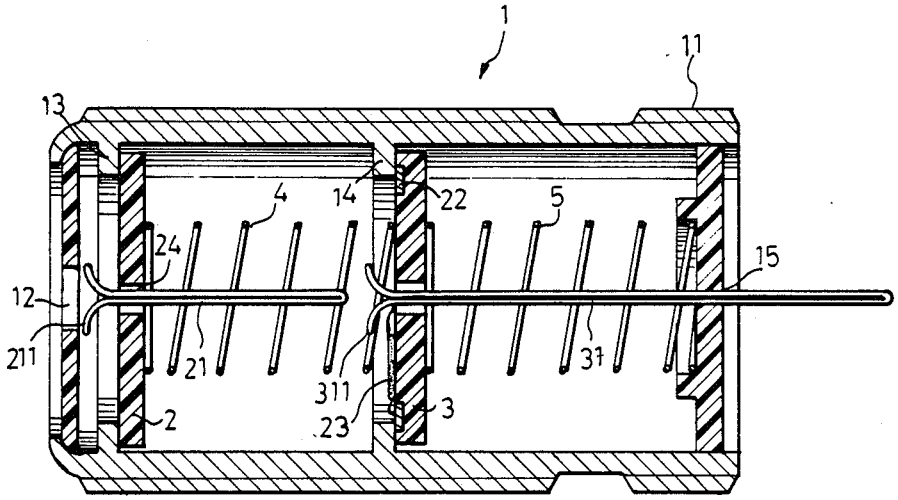
FIG. 2 is a cross-sectional view of the present invention in its unused state.

Referring to FIGS. 1 and 2, it can be seen that the housing (1) is threaded (11) on it's outer surface so as to engage with the high frequency selecting switch. A fist ring rim (13) projects from the front end of the inner surface of the housing (1) and a second ring rim (14) projects from the middle of the inner surface of the housing (1) so as to divide the hollow space of the housing (1) into front and rear portions. An insertion hole (12) is in the middle of the front surface of the housing (1) and an output hole (15) is in the middle of the rear surface of the housing (1).

A first sliding block (2) is disposed in the front portion of the housing (1) and contacts with the first ring rim (13). The first sliding block (2) has a hole (24) at the center. A first spring (4) is disposed between the first sliding block (2) and the second ring rim (14) so as to force the first sliding block (2) against the first ring rim (13). A first conductor pin (21) is disposed in the front portion of the housing (1) and inserted through the first spring (4) and the hole (24) of the first sliding block (2). The front end of the first conductor pin (21) forms a clamping member (211) which juts through the hole (24) of the first sliding block (2).

A second sliding block (3) is disposed in the rear portion of the housing (1) and has a hole (32) at its center. A conductor ring (22) is disposed at the front surface of the second sliding block (3). A spring (5) is disposed between the second sliding block (3) and the rear surface of the housing (1) so as to force the second sliding block (3) and the conductor ring (22) against the second ring rim (14). A second conductor pin (31) is disposed in the rear portion and inserted through the second spring (5) and the hole (32) of the second sliding block (3). Further, the front end of the conductor pin (31) forms a clamping member (311), which juts beyond the hole (32) of the second sliding block (3), and the rear end of the conductor pin (31) juts through the output hole (15) of the rear surface of the housing (1). A thick film resistor (23) is connected between the conductor ring (22) and the clamping member (311).

Referring to FIG. 3 again, it can be seen that nothing is inserted into the insertion hole (12) of the housing (1). The first and second sliding blocks (2 and 3) are pressed by the springs (4 and 5) to contact with the first and second ring rims (13 and 14), respectively. Of course, the conductor ring (22) also contacts with the second ring rim (14). There is a certain resistance, which is caused by the thick film resistor (23), between the housing (1) and the second conductor pin (13). The first and second conductor pins (21) and (31) are separated so that undersirable signals from the surroundings can be absorbed and will not interfere with the output signals.

Figure 3:
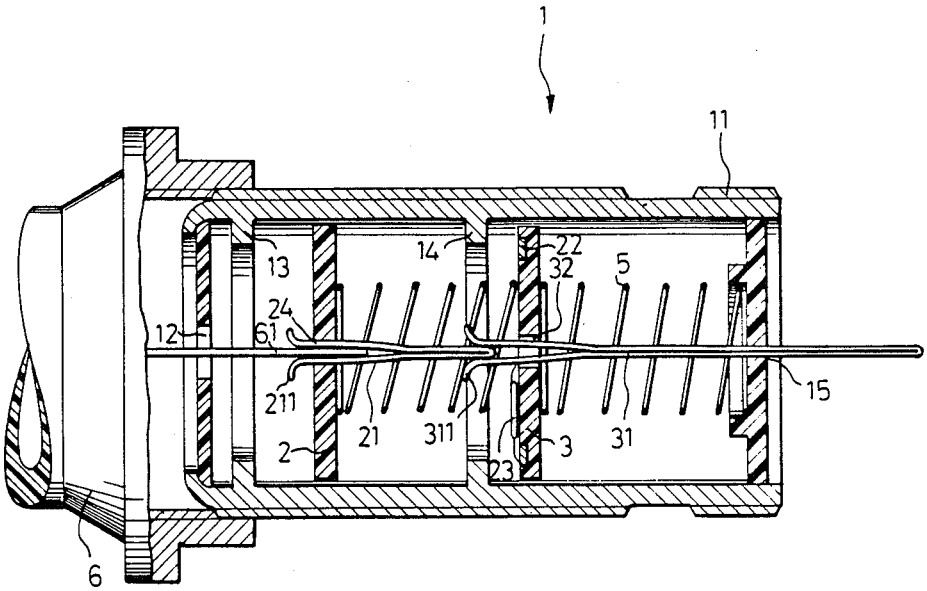
FIG. 3 is a cross-sectional view of the present invention with the pin from the cable being inserted.
Figure 4:
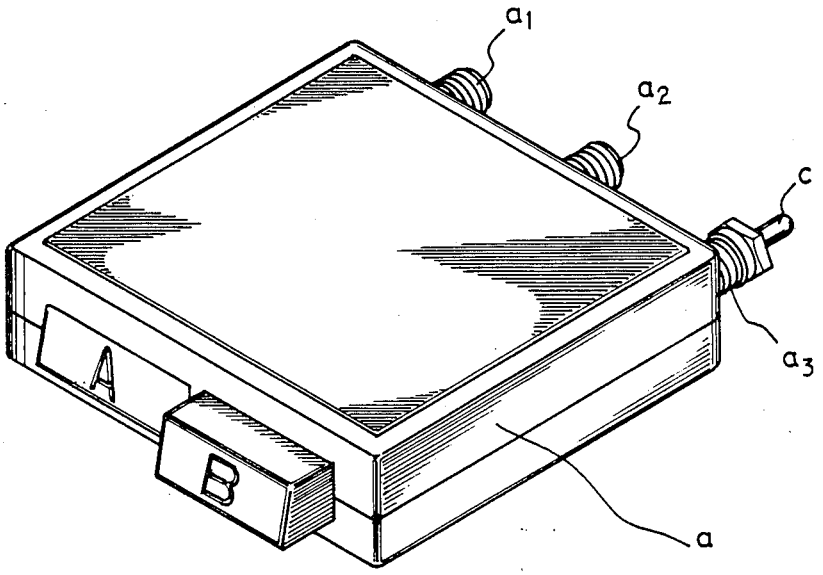
FIG. 4 PRIOR ART
FIG. 4 is a perspective view of a prior art.
Figure 5:
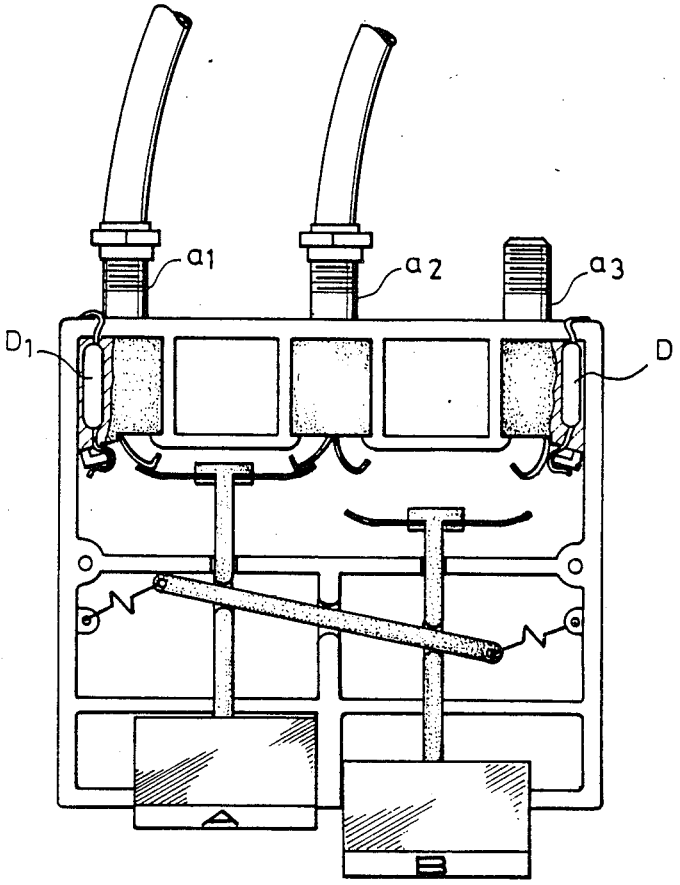
FIG. 5 PRIOR ART
FIG. 5 is a cross-sectional view of a prior art.

Still referring to FIG. 3, it can be seen that when the conductor pin (61) of the cable (6) is placed through the insertion hole (12) into the clamping member (211) and the first conductor pin (21) together with the first sliding block (2) are moved backward, so that the rear end of the first conductor pin (21) is inserted into the clamping member (311). This, in turn, pushes the second conductor pin (31), together with the second sliding block (3), so that the conductor ring (22) is separated from the second ring rim (14) and so that the thick film resistor (23) is in an open state. Therefore signals can be transmitted from the cable (6), via the terminal, to the switch. When the cable (6) is removed, sliding blocks (2 and 3) return to the original position, as shown in FIG. 3, and provide a certain resistance to prevent the interference from undesirable signals from the surroundings. The proper resistance of the thick film resistor (23) is from 50 to 100 ohms. The resistance of the thick film resistor (23) is 75 ohms, which is equal to the resistance of the cable (6), so as to be more suitable for preventing interference.

I claim:

1. A high-frequency selecting switch terminal comprising:

a hollow housing with a threaded outer surface, a first ring rim projecting from the front end of the inner surface, a second ring rim projecting from the middle of the inner surface which divides the housing into a front and a rear portion, an insertion hole provided in the middle of the front surface of the housing and an output hole provided at the rear surface of the housing;

a first sliding block disposed in the front portion of said terminal and contacting with the rear end of the first ring rim having a hole at the center;

a first spring disposed between the first sliding block and the second ring rim which pushes the first sliding block against the first ring rim;

a first conducting pin disposed in the front portion of said terminal which inserts through the first spring and the hole of the first sliding block, the front end of the first conductor pin being a clamping member which fits into the hole of the first sliding block;

a second sliding block including a rear portion having a hole in its center and a front portion having a conductor ring;

a second spring disposed between the second sliding block and the rear surface of the housing which pushes the second sliding block and a conductor ring so as to contact with the second ring rim;

a second conductor pin in the rear portion of said housing and inserted through the second spring and the hole of the second sliding block, the front end of the second conductor pin including a clamping member, said clamping member fitting into the hole of the second sliding block, and the rear end of the second conductor pin sticking out of the output hole of the rear surface of the housing; and a thick film resistor connected between the conductor ring and the clamping member.

2. A high-frequency selecting switch terminal, as set forth in claim 1, wherein the resistance of the thick film resistor is between 50 ohm and 100 ohm.

3. A high-frequency selecting switch terminal, as set forth in claim 2, wherein the resistance of the thick film is approximately 75 ohm.

* * * * *